United States Patent [19]

Kahlow et al.

[11] 4,157,024

[45] Jun. 5, 1979

[54] FORMING DIE AND PROCESS FOR TUBULAR FITTINGS

[75] Inventors: Kurt J. Kahlow, North Canton; Richard L. Holbrook, Louisville, both of Ohio

[73] Assignee: The Babcock & Wilcox Company, New York, N.Y.

[21] Appl. No.: 866,735

[22] Filed: Jan. 3, 1978

[51] Int. Cl.[2] ..... B21D 7/08

[52] U.S. Cl. ..... 72/168; 72/369; 72/467

[58] Field of Search ..... 29/157 A; 72/168, 467, 72/352, 356, 369, 166, 167

[56] References Cited

U.S. PATENT DOCUMENTS

| | | | |
|---|---|---|---|
| 1,996,838 | 4/1935 | Snell | 72/369 X |
| 2,976,908 | 3/1961 | Ferguson | 72/168 X |
| 3,354,681 | 11/1967 | Lombard | 29/157 A X |

*Primary Examiner*—Milton S. Mehr

*Attorney, Agent, or Firm*—J. M. Maguire; R. C. Mai

[57] ABSTRACT

A method and apparatus of forming a tube by pushing it through a die to form high quality tubular fittings.

6 Claims, 5 Drawing Figures

FORMING DIE AND PROCESS FOR TUBULAR FITTINGS

BACKGROUND OF THE INVENTION

This invention relates to the manufacture of tubular fittings and, more specifically, to a novel method of forming high quality elbow and return bend fittings from straight tubular lengths.

Numerous methods of forming elbow and return bend fittings have been developed over the years. U.S. Pat. No. 3,354,681 discloses a method and apparatus for forming elbows from a tubular section by pushing through a forming die. A portion of this apparatus consists of a "tapered land" which the inventor claims to cause bending by differential friction, the friction force being greater on the inside radius of the bent tubular section than on the outside radius, which is in direct contradiction to the finding of our invention.

SUMMARY OF THE INVENTION

The present invention overcomes many of the problems associated with the prior art applied to the forming of tubular fittings. To form the fitting, a tubular member is pushed through a forming die consisting of several sections. One possible arrangement for these sections is as follows:

The member is subjected to a swaging operation in the first section; this initiates bending. A second section contributes further bending to the member. A second swaging section (the third section) provides a longitudinal compressive stress to that portion of the member in the forementioned bending section and furthers bending. Finally, for dimensional control, a sizing section follows the second swaging section.

The various features of novelty which characterize the invention are pointed out with particularity in the claims annexed to and forming a part of this disclosure. For a better understanding of the invention, its operating advantages and specific results to be obtained by its use, reference should be had to the accompanying drawings and descriptive matter in which there is illustrated and described a typical embodiment of the invention.

DESCRIPTION OF THE PREFERRED EMBODIMENT

Figure 1:
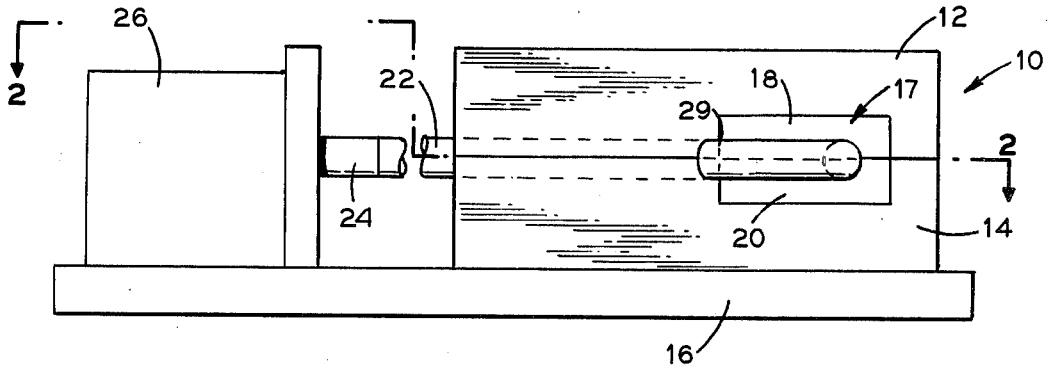
FIG. 1 generally shows the side view of a typical apparatus arrangement useful in carrying out the inventive process.
Figure 2:
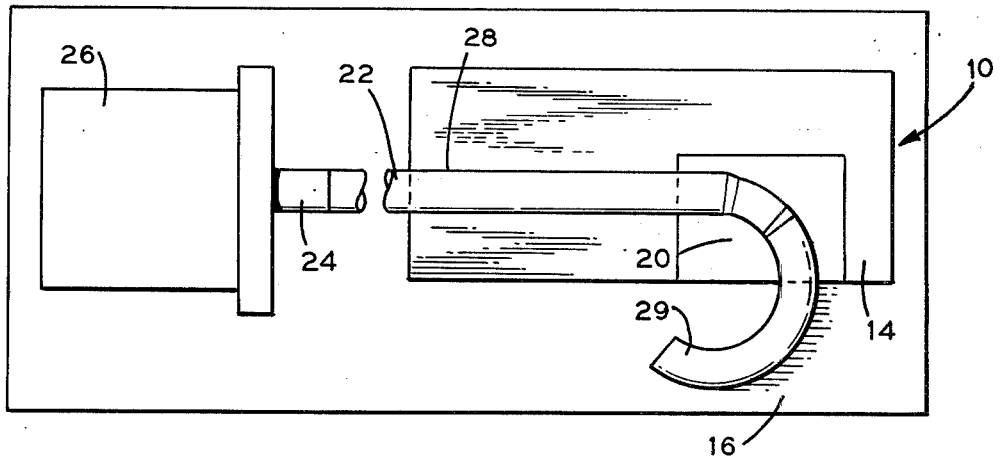
FIG. 2 shows a sectionalized plan view taken along lines 2—2 of FIG. 1.
Figure 3:
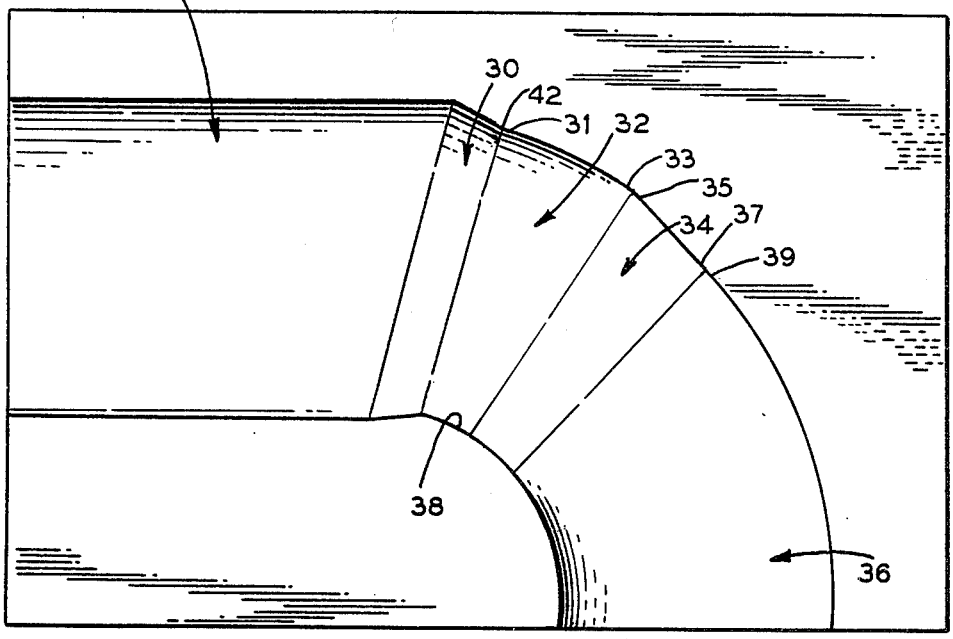
FIG. 3 shows a cutaway plan view of a typical forming die insert.

The present invention is generally directed at a process for forming tubular fittings or elbows, such as 45° and 90° elbows and 180° returns, of high quality and of circular cross section. Referring generally to FIGS. 1 and 2, a die support assembly 10, comprised of an upper die support fixture 12 and a lower die support fixture 14, rests on base plate 16. The die support assembly 10 houses forming die 17. Confined within support fixture 12 is upper forming die insert 18, and likewise confined in lower forming die support fixture 14 is lower forming die insert 20. Together, inserts 18 and 20 comprise forming die 17. Tubular member 22, treated with a commercial lubricant, is typically pushed into assembly 10 via pushing bar 24 which moves towards the die assembly via a power-driven ram 26. A typical inlet guide secton 28 (FIG. 2) aligns the tube 22 for proper entry into the forming die 17 shown as the lower forming die insert 20 in FIG. 2. While inlet guide section 28 is illustrated as of uniform diameter throughout its length, its exit end may be proportioned and arranged to change the cross-sectional geometry of tube 22 prior to entering first swaging section 30 (FIG. 3). The formed fitting 29 exits forming die 17.

The elbow forming process may be thought of as consisting of separate, although interrelated, forming operations. These operations are multiple in number. One of the possible combinations employs four (4) sequential forming sections:

(a) Initial bending via a first swaging section
(b) Bending with no swaging
(c) Additional bending via a second swaging section
(d) Sizing with no swaging The four operations are preferably carried out sequentially in one forming die.

FIG. 3 illustrates one-half of forming die section 17 for carrying out the above listed operations sequentially. The composite die is comprised of a tubular inlet guide section 28 of uniform diameter, a first swaging secton 30, a tubular bending section 32 of uniform diameter, a second swaging section 34, and a tubular sizing section 36 of uniform diameter. Although FIG. 3 shows a cavity which extends around a 90° arc from start of section 30 to end of section 36, this is not necessarily a requirement of the design. The cavity may be shortened to less than 90° or lengthened to more than 90°, depending upon the overall design requirements and number of forming sections used.

Figure 4:
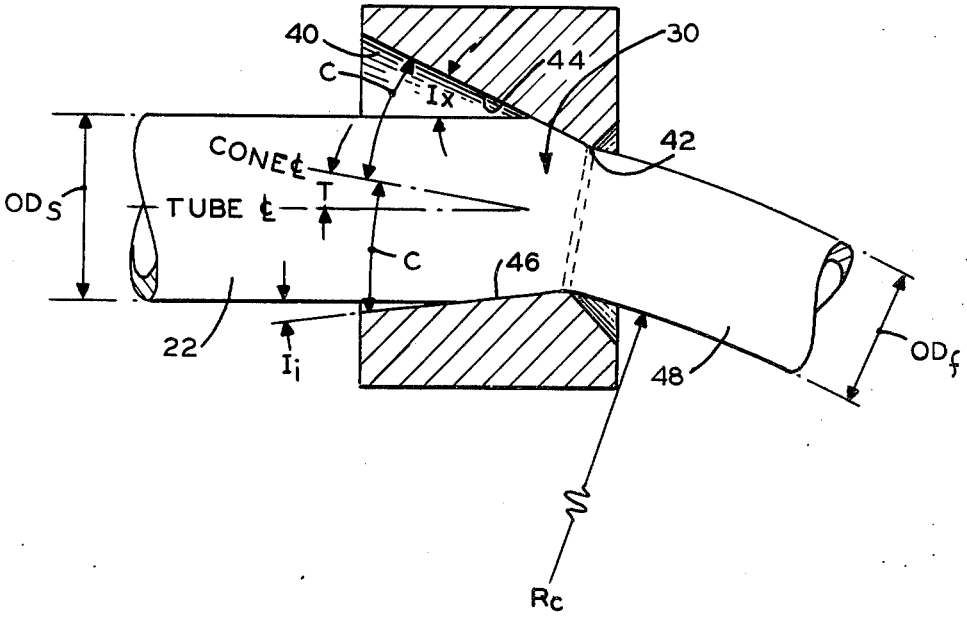
FIG. 4 generally depicts a cutaway plan view of the first swaging section of the forming die insert showing a particular form of a bilaterally symmetric die composed of conical sections with a tubular member therein.

First swaging section 30 may be fashioned for differential swaging or for swaging on that portion of the tube which is referred to as the extrados of the bent member. In either instance, the operation of section 30 is significantly influenced by percent reduction of the outer diameter (hereinafter referred to as OD reduction) and the subsequently defined tilt angle T (FIG. 4).

Bending section 32 opens at end 31 to throat 42 of section 30 and forces the tubular member to conform to a tighter radius than it normally would just exiting section 30, thus promoting additional bending. This section does not cause diameter reduction but does influence the bend radius of the tube. The curvature of this section is very important, but generally should have an inner radius close to that of the formed fitting.

Second swaging section 34 opens at its large end 35 to the other end 33 of the bending section 32. As in section 30, this section also swages the tube and has certain similar geometric features. That portion of the die contacting the tube's inner radius is preferably a continuation of the inner radius 38 of the bending section 32. Swaging section 34 increases the compression in the prior bending section 32 forcing the tube to "fill out" the inner and outer radii of section 32. It also ideally completes bending ahead of the sizing section 36 and forces the tube against the inner radius feeding into the sizing section 36.

Sizing section 36 opens at one end 39 to the small end 37 of the second swaging section 34 and is similar to bending section 32 in that neither section causes diameter reduction of the member. However, section 36 exhibits a tighter outer radial measurement than does section 32. Section 36 is used mainly for dimensional control.

Tube wall thickness changes as the tube passes through the forementioned four forming sections in the following general manner: In the first swaging section 30, the wall thickens at both the inner and outer radius. In the bending section 32, the inner radius wall thickens and the outer radius wall thins. In the second swaging section 34, the outer radius wall thickens. In the sizing section 36, the wall, preferably, does not change, but in actuality can change in either direction depending upon the design of the previous three forming sections.

First swaging section 30 has bilateral symmetry. In the particular embodiment shown, swage section 30 may be described as similar to a tilted die. The die shown is essentially a conventional forming die with its axis tilted with respect to the axis of the incoming tube. The use of tilted dies in a tube forming process and critical limits pertaining thereto are disclosed in copending application Ser. No. 866,733 filed Jan. 3, 1978. Referring to FIG. 4, the combination of section 30 with tubular member 22 having been pushed therein is characterized by certain geometric considerations. Section 30 may be a truncated hollow conical section whose entrance cone 40 may be described with respect to the starting tube 22 by reference to the following symbols:

C=the die cone angle (often called the semi-cone angle) which is the angular relationship between the surface of the cone and the centerline of the cone.

T=die tilt angle which is the angular relationship between the die or cone centerline and the entering tube centerline.

$I_x$=maximum die inlet angle, equal to C+T.

$I_i$=minimum die inlet angle, equal to C−T.

$R_c$=inner radius of curvature of the bent tube.

It will be observed that $I_x$ and $I_i$ define oppositely located sections of the entrance cone 40 with respect to the centerline of member 22.

The unbent tube 22 is pushed through cone 40 and passes through throat 42 which represents the minimum opening of the conical section. Tube 22, which started with an original diameter $OD_s$, is deformed by passage through the section to a bent tube or partially formed fitting 48 exhibiting a diameter $OD_f$.

As tubular member 22 is pushed through die 30, the upper portion (FIG. 4) of the tube circumference experiences a larger swage (diameter reduction) than the lower portion, the larger swage occurring at that portion of the cone associated with the maximum inlet angle $I_x$, thus causing greater elongation in the upper portion of the tubular member and resulting in bending. It will be noted that during pushing of the tubular member 22 through die 30, a portion of the member's circumference closest to the $I_i$ element 46 of the entrance cone contacts the die prior to the opposed portion contacting the $I_x$ element 44 of the cone. This offset of initial contact in the entrance cone 40 results in an offset of die forces normal to the tube 22, thus producing a couple (or moment) which promotes further tube bending. It is understood that the above description of die 30 is only an example of a particular class of bilaterally symmetric dies.

Subsequent to the tube passing through throat 42, the tube successively passes through bending section 32 for further forming, second swaging section 34 for still further forming, and sizing section 36 for completion of the fitting, which then exits from the die. The formed fitting may then be cut to the appropriate length. An alternate method of forming the tubular fittings consists of cutting the straight length of tubing into the desired lengths of the finished product and then pushing these pre-cut lengths through the composite die in series. Different cut lengths result in different types of fittings, such as 45° and 90° elbows and 180° returns. This disclosure teaches a method by which fittings of a particular set of dimensions can be formed from a long straight tube section or from pre-cut lengths of tubing in a semi-continuous or continuous process.

The foregoing description applies to the preferred embodiment and is illustrated on the drawings. However, other die arrangements are possible and various combinations can be used, depending on the desired design of the finished product, such as:

(a) An inlet guide section, a swaging section, and a bending section (b) An inlet guide section, a swaging section, a bending section, and a sizing section (c) An inlet guide section, a first swaging section, a bending section, and a second swaging section (d) An inlet guide section, a first swaging section, a bending section, a second swaging section, and a sizing section (e) An inlet guide section, a first swaging section, a first bending section, a second swaging section, and a second bending section (f) An inlet guide section, a first swaging section, a first bending section, a second swaging section, a second bending section, and a sizing section More complicated arrangements involving more sections are possible, but, because of complexity, are impractical.

Figure 5:
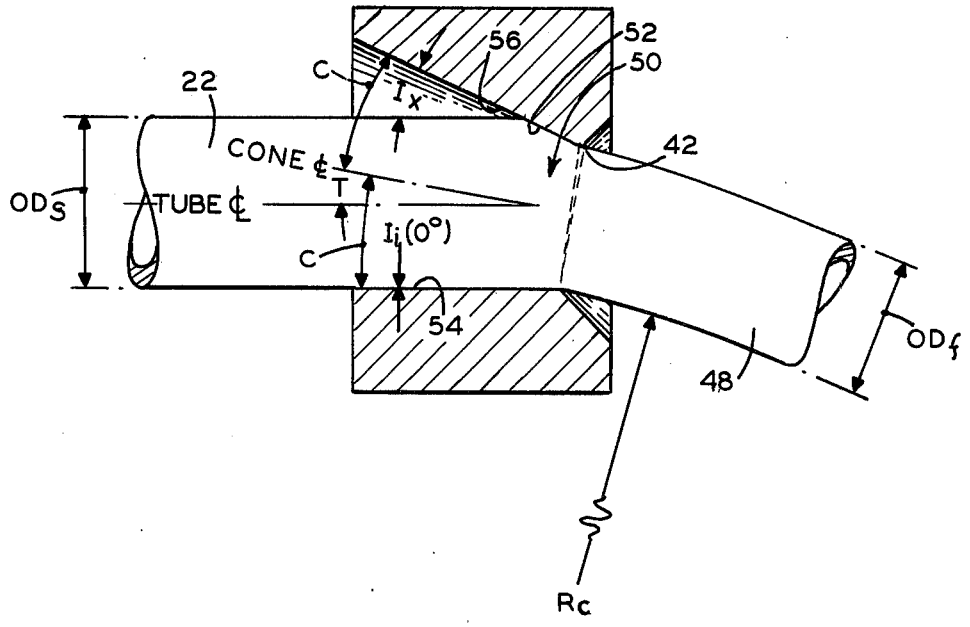
FIG. 5 shows an alternate embodiment of that shown in FIG. 4.

FIG. 5 shows an alternate embodiment of the arrangement of swaging section 30 designated as section 50. The basic difference between sections 30 and 50 is that in section 50 the minimum die inlet angle $I_i$ is 0°, and no swaging occurs on that element of the tube circumference contacting the lower face 54. As shown, tube 22, with an outer starting diameter of $OD_s$, is pushed into section 50 passing through a truncated conical section 52. The member remains in contact with the lower face 54 ($I_i$=0°), while experiencing diameter reduction by contacting the upper face 56 of the cone 52. The lower face 54 is tangent to inner radius 38 (FIG. 3) of the bending section at the point where the sections meet. Tube 22 is forced through the throat 42 and feeds into bending section 32 (not shown in FIG. 5) and continues as previously described.

This inventive process and concomitant fitting exhibit numerous advantages as compared to existing fitting forming processes: The process requires no internal tube support, which makes possible the rapid forming of fittings from long tube sections. The process is applicable to any ductile material able to withstand the forces associated with the process. The process can be used cold, warm, or hot. Because no internal tools are used, the fittings are free of any internal scarring. The fittings have also been found to have uniform wall thickness along their entire length, relatively little or no wall thinning on their outer radius, and outside diameters that are circular along their entire length.

The embodiments of the invention in which an exclusive property or privilege is claimed are defined as follows:

1. A composite die for forming an elbow from a straight tube pushed therethrough comprising a tubular inlet guide section, a swaging section in the form of a truncated cone connected and opening at its large end to one end of the inlet guide section and constructed and arranged so that the tube while pushed therethrough is subjected to circumferential swaging forces varying from a maximum at one location on its circumference to a minimum value at another opposed location on its circumference and to subject it to an offset of die forces producing a force moment, to cause bending of the tube about the location subjected to the minimum swaging forces and thickening of the tube wall, partial forming of the elbow and reduction in tube diameter, and a tubular bending section, forming a passageway of uniform diameter connected and opening at one end to the small end of the cone of the swaging section and constructed and arranged so that the tube while pushed therethrough is subjected to further bending to further form the elbow.

2. The composite die of claim 1 further comprising a second swaging section connected to the opposite end of the bending section and constructed and arranged so that the tube while pushed therethrough is subjected to circumferential forces varying from a maximum at one location on its circumference to a minimum value at another opposed location on its circumference and to subject it to an offset of die forces producing a force moment to cause further bending of the tube about the location subjected to the minimum swaging forces, further reduction in tube diameter and further increase in tube wall thickness, and further forming of the elbow.

3. The composite die of claim 2 further comprising a tubular sizing section forming a passageway of uniform diameter connected to the exit end of the second swaging section and constructed and arranged so that the tube while pushed therethrough is subjected to final formation of the elbow.

4. A method of forming an elbow from a straight tube in a composite die having in sequence a tubular inlet guide section, a swaging section and a tubular bending section of uniform diameter, the method comprising pushing the tube through the inlet guide section and through the swaging section to subject it to circumferential swaging forces varying from a maximum value at one location on its circumference to a minimum value at another opposed location on its circumference and to subject it to an offset of die forces producing a force moment, to cause bending of the tube about the location subjected to the minimum swaging forces and thickening of the tube wall, partial forming of the elbow and reduction in tube diameter and pushing the tube through the bending section to further bend the tube and further form the elbow, while maintaining a uniform tube diameter.

5. The method of forming an elbow as in claim 4 wherein the sequence procedure further comprises pushing the tube through a second swaging section to subject it to circumferential swaging forces varying from a maximum value at one location on its circumference to a minimum value at another opposed location on its circumference and to subject it to an offset of die forces producing a force moment, to cause further bending about the location subjected to the minimum swaging forces, further reduction in the tube diameter and further increase in tube wall thickness and further forming of the elbow.

6. The method of forming an elbow as in claim 5 wherein the sequence procedure further comprises pushing the tube through a tubular sizing section of uniform diameter for forming the elbow.

* * * * *